US006851682B2

(12) United States Patent
Durocher

(10) Patent No.: US 6,851,682 B2
(45) Date of Patent: Feb. 8, 2005

(54) IN-LINE ROLLER SKATE WITH VIBRATION ABSORPTION SYSTEM

(75) Inventor: Jacques Durocher, St-Jérôme (CA)

(73) Assignee: Bauer Nike Hockey Inc., St.-Jérome (CA)

( * ) Notice: Subject to any disclaimer, the term of this patent is extended or adjusted under 35 U.S.C. 154(b) by 42 days.

(21) Appl. No.: 10/038,578

(22) Filed: Jan. 8, 2002

(65) Prior Publication Data

US 2002/0093154 A1 Jul. 18, 2002

(30) Foreign Application Priority Data

Jan. 12, 2001 (CA) ..... 2330847

(51) Int. Cl.[7] ..... A63C 17/02; A63C 17/04; A43B 5/04

(52) U.S. Cl. ..... 280/11.225; 280/11.221; 280/11.231; 36/117.3; 36/115

(58) Field of Search ..... 280/11.225, 11.221, 280/11.14, 11.19, 11.28, 7.13, 11.3, 11.231, 11.233; 36/117.5, 117.3, 103, 114, 115, 27, 28, 29, 35 B, 35 R, 37, 88, 104, 172

(56) References Cited

U.S. PATENT DOCUMENTS 5,343,639 A 9/1994 Kilgore et al.
5,405,156 A 4/1995 Gonella
5,462,295 A * 10/1995 Seltzer ..... 280/11.19
5,639,104 A 6/1997 Haldemann
5,690,344 A 11/1997 Chen
5,823,543 A 10/1998 Burns et al.
5,842,706 A 12/1998 Chang
5,855,383 A 1/1999 Harr et al.
5,961,131 A 10/1999 Hilgarth
6,039,329 A * 3/2000 Burns et al. ..... 280/11.19
6,053,512 A 4/2000 Chang
6,119,371 A * 9/2000 Goodwin et al. ..... 36/29
6,394,469 B1 5/2002 Borel
6,449,878 B1 * 9/2002 Lyden ..... 36/27
6,557,864 B1 * 5/2003 Lenoir ..... 280/11.221
2002/0194747 A1 * 12/2002 Passke et al. ..... 36/29

FOREIGN PATENT DOCUMENTS

| | | |
|---|---|---|
| CA | 2201814 | 4/1997 |
| CA | 2295778 | 5/1998 |
| CA | 2288915 | 11/1999 |
| FR | 2742063 A1 | 12/1995 |

* cited by examiner

*Primary Examiner*—Christopher P. Ellis
*Assistant Examiner*—G B Klebe

(57) ABSTRACT

A skate is disclosed comprising a skate boot including an outsole and an upper for enclosing and supporting a human foot. The outsole comprises a resilient component insert for reducing shocks and vibrations transferred from the skating surface to the human foot.

27 Claims, 9 Drawing Sheets

IN-LINE ROLLER SKATE WITH VIBRATION ABSORPTION SYSTEM

FIELD OF THE INVENTION

The invention relates in general to an in-line roller skate or an ice skate and in particular to a vibration absorption system for reducing the transfer of shocks and vibration induced by the skating surface, from the wheels or the ice skate blade to the feet of the skater.

BACKGROUND OF THE INVENTION

In-line roller skating has become a very popular activity and is practiced as an exercise and a sport, but also as a means for sightseeing or for commuting in general. In-line roller skates are therefore increasingly used on roads and on generally rough or hard surfaces which are often very uncomfortable for the skater as the bumps, cracks and holes of any shape and size induce shocks and vibrations of the wheels which are transferred directly to the foot of the skater. The skater's feet may become numb from repeated vibrations induced by rough surfaces and joints, including the ankle joints and the knee joints, and muscles may become sore from repeated shocks.

To alleviate this problem, in-line skates may include a suspension system of some sort disposed between the chassis carrying the wheels and the skate boot in order to separate the two components and therefore reduce the transfer of shocks and vibrations from the wheels to the skate boot. For example, a particular in-line roller skate sold under the trade-mark Bauer® comprises a thin, flat elastomer component fitted between the chassis and the skate boot. The elastomer component is rigidly sandwiched between the chassis and the skate boot and provides some dampening of shocks and vibrations transferred from the wheels to the skate boot.

Other suspension systems have been devised which aim at absorbing vibration and shocks by pivotally connecting the chassis to the skate boot. One such design is disclosed in U.S. Pat. No. 5,842,706 to Sreter in which the skate boot is pivotally mounted to the chassis at the front end thereof and is connected at the rear portion of the chassis via a spring, guiding post and mounting socket assembly which allows the skate boot to move vertically relative to the chassis thereby absorbing some of the shocks and vibrations induced by a rough surface at the heel portion of the boot. However, since the front portion of the chassis is secured to the skate boot through a pivot pin, shocks and vibrations are transferred to the boot unhindered or undampened.

Another more-elaborate suspension system is disclosed in International application No. PCT/US97/00387. The system consists of a front and rear double pivot mechanism disposed between the skate boot and the chassis. The double pivot mechanism includes a first pivot mounted to the skate boot, a pivot member rotatably connected to the first pivot and having a second pivot attached to the chassis. A resilient member is disposed between the skate boot and the pivot members of each double pivot mechanism such that the front and rear portions of the skate boot are partially isolated from the chassis and shocks and vibrations are partially transferred through the mechanical pivots yet partially absorbed by the resilient members.

These suspension or vibration absorption systems represent a compromise between the required firmness and responsiveness of an in-line skate and a minimum degree of comfort for the legs of the user. Indeed when a chassis is allowed to move relative to the skate boot or when a soft material is positioned between a chassis and the skate boot, the chassis is able to sway laterally as well as vertically and the responsiveness of the skate is greatly diminished. A chassis mounted to a skate boot in the manner described above has an inherent tendency to become misaligned vertically and laterally relative to the skate boot during various maneuvers where high forces are applied to the in-line skate such as when turning or accelerating. The chassis is somewhat loosely connected to the skate boot because of the flexibility of the mechanical fittings of the various moving parts or of the soft material positioned between the chassis and the skate boot.

Hence prior existing suspension and/or vibration absorption systems for in-line skates are less responsive and somewhat unstable at high speed as well as in turning maneuvers than a skate with a rigidly mounted chassis.

Thus there is a need for an in-line roller skate having a suspension/vibration absorption system which is able to reduce the transfer of shocks and vibrations to the foot of the skater yet remains responsive and firm during various maneuvering.

SUMMARY OF THE INVENTION

It is thus an object of the invention to provide a skate which has a vibration absorption system for reducing the transfer of shocks and vibrations to the foot of the skater.

As embodied and broadly described herein, the invention seeks to provide an in-line roller skate comprising: (a) a chassis carrying a plurality of aligned wheels; and (b) a skate boot including an outsole and an upper for enclosing and supporting a human foot, said outsole including means for mounting said chassis to said skate boot, said outsole further including a resilient component inserted thereto for reducing shocks and vibrations transferred from said chassis to the human foot.

Advantageously, the outsole comprises a heel portion and a front portion, the heel portion of the outsole including a fork-like structure having upper and lower platforms defining a space therebetween for receiving the resilient component. The upper platform and the lower platform branch out from an intersecting portion of the fork-like structure, and are adapted to flex at the intersecting portion for compressing the resilient component when the in-line roller skate is in normal use. Advantageously, a mounting bracket for mounting a rear portion of the chassis to the outsole extends from the lower platform and another mounting bracket for mounting a front portion of the chassis to the skate boot extends from a front portion of the outsole. Preferably, the resilient component is made of rubber or other suitable elastomeric material and also may comprise at least one air pocket. The chassis may be integrally connected to the outsole.

As embodied and broadly described herein, the invention also seeks to provide an ice skate comprising: (a) a skate boot upper for enclosing and supporting a human foot; (b) an outsole mounted to said skate boot upper; and (c) a blade holder having front and rear pedestals and a bridge portion connecting said front and rear pedestals, said blade holder being mounted to said outsole; wherein said outsole comprises a resilient component inserted thereto for reducing shocks and vibrations, said outsole further comprising a fork-like structure having upper and lower platforms defining a space therebetween for receiving said resilient component, said upper and lower platforms branching out from an intersection portion of said fork-like structure and being adapted to flex at said intersection portion for compressing said resilient component. The blade holder may be integrally connected to the outsole.

Other objects and features of the invention will become apparent by reference to the following description and the drawings.

BRIEF DESCRIPTION OF THE DRAWINGS

A detailed description of the preferred embodiments of the present invention is provided herein below, by way of example only, with reference to the accompanying drawings, in which.

Figure 1:
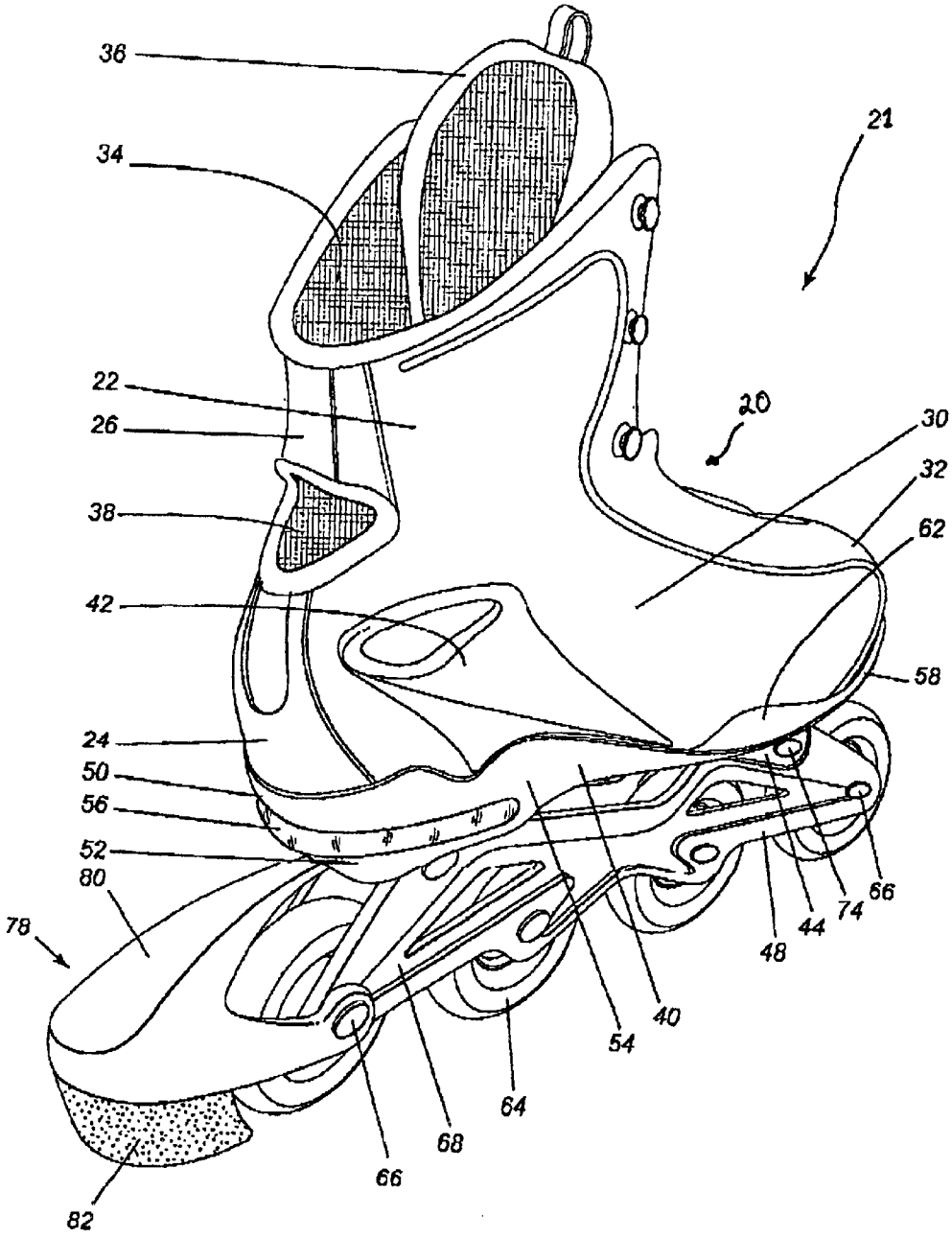
FIG. 1 is a rear perspective view of an in-line roller skate according to one embodiment of the invention.
Figure 3:
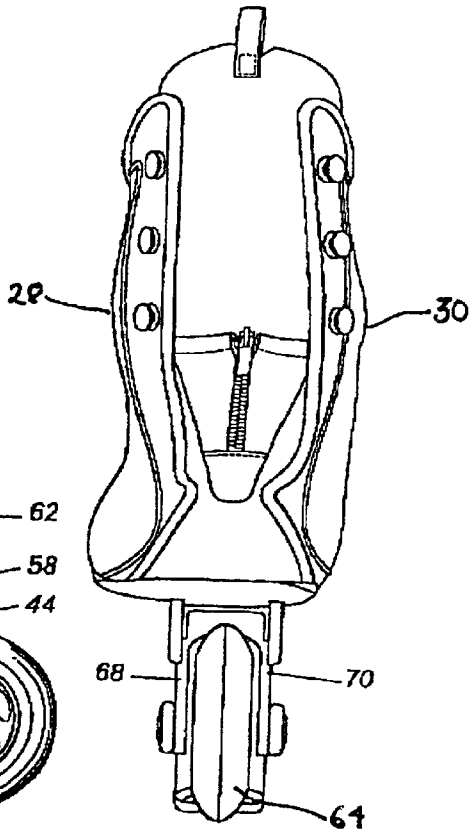
FIG. 3 is front elevational view of the in-line roller skate shown in FIG. 1.

In the drawings, preferred embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF PREFERRED EMBODIMENTS

In FIGS. 1 to 4, an in-line roller skate constructed in accordance with the present invention is illustrated generally and identified by reference numeral 21. In-line roller skate 21 comprises a skate boot 20 and a wheel carrying chassis 48. Skate boot 20 includes an upper 22 having a heel counter portion 24 which cups around the wearer's heel, an ankle support 26 enclosing a substantial portion of the wearer's ankle, a lateral quarter panel 28 and a medial quarter panel 30 extending along each side of the wearer's foot and ankle and a toe covering portion 32. Upper 22 further includes an inner lining 34 which is a layer of soft material covering the inside walls of upper 22 or at least a portion thereof and a cushioning tongue 36 also having an inner lining made of soft material to comfortably enclose the wearer's foot within skate boot 20. Upper 22, as illustrated, features an aperture 38 located between heel counter 24 and ankle support 26. Aperture 38 serves as a ventilation means and provides added comfort to the wearer' Achilles' heel by removing any potential pressure points which are common in this area and often painful especially when the skate is new. However, skate boot 20 may be constructed without aperture 38 such that the back of skate boot 20 is completely closed.

Skate boot 20 also features a pair of side plate 42 located one on each side of skate boot 20. Side plates 42 extend from the bottom portion of upper 22 to an area located just above the wearer's heel. Side plates 42 provide added rigidity to skate boot 20 to support the forward portion of the wearer's heel. Indeed, each side plate 42 extend diagonally upwardly from the front of the heel to a point above the heel bone near the Achilles' tendon such that side plates 42 assist in laterally supporting the wearer's heel and the back of the wearer's foot generally. The lateral support provided by side plates 42 prevents skate boot 20 from bending sideways and provides the skater with increased control of the skate.

Figure 2:
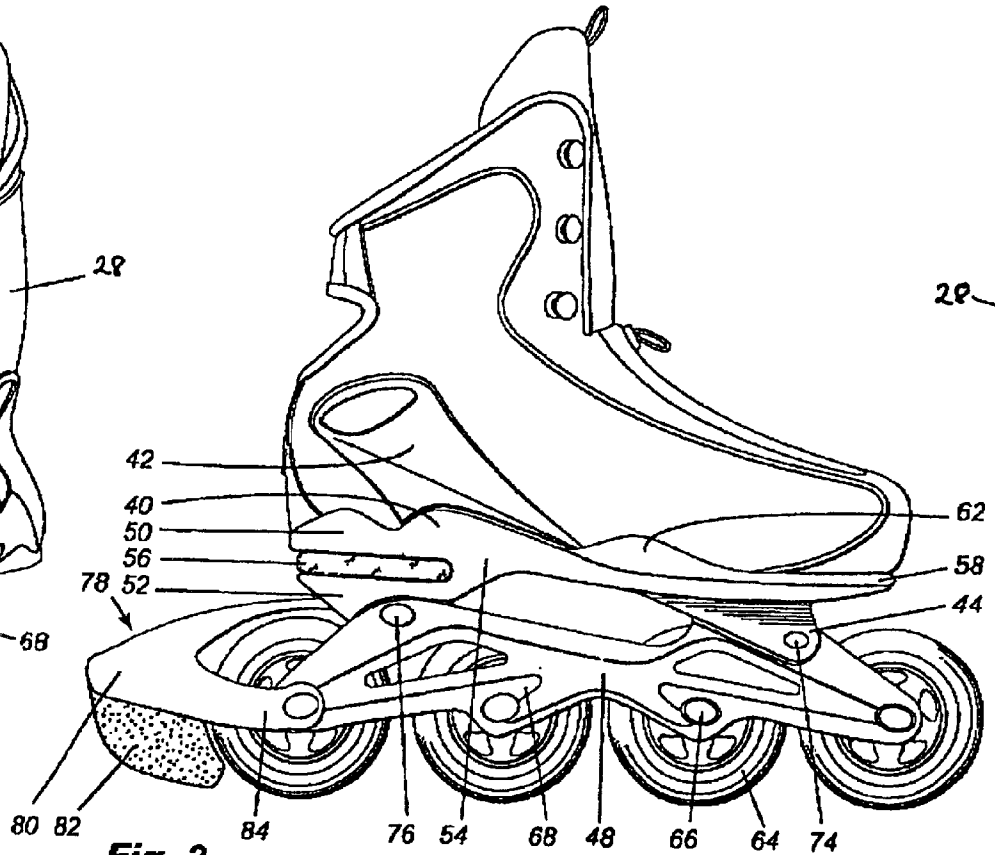
FIG. 2 is a right side elevational view of the in-line roller skate shown in FIG. 1.
Figure 4:
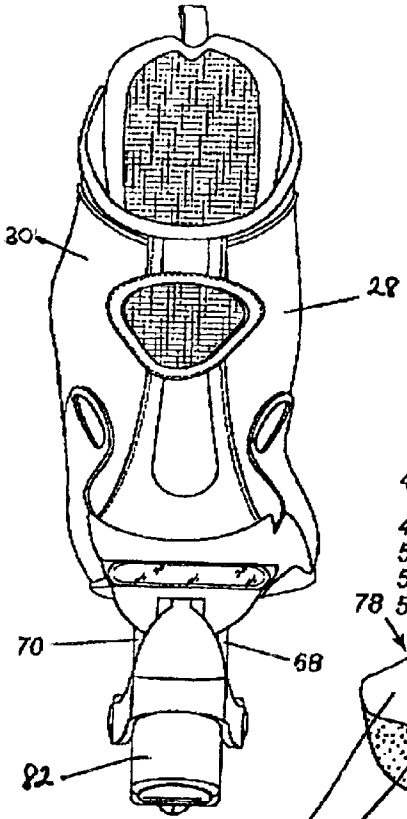
FIG. 4 is a rear elevational view of the in-line roller skate shown in FIG. 1.

Skate boot 20 is completed with an outsole 40 covering the bottom portion of upper 22. In accordance with one embodiment of the invention, outsole 40 is molded from a rigid plastic and mounted to the bottom surface of upper 22 with adhesive or nails, or both. Outsole 40 extends the length of skate boot 20 and includes mounting brackets 44 and 46 (FIG. 5) adapted to mount chassis 48 to skate boot 20. As best seen in FIG. 2, the rear or heel portion of outsole 40 is split in two segments including an upper platform 50 and a lower platform 52 which form a fork-like heel structure by separating into two segments the heel portion of outsole 40. Upper and lower platforms 50 and 52 branch out from an intersecting portion 54. A deformable absorption insert 56 shaped to conform to cavity 51 defined by upper and lower platforms 50 and 52, is sandwiched between upper and lower platforms 50 and 52, within cavity 51 and act as a cushioning and vibration absorption device for skate boot 20.

Insert 56 can be made in a variety of elastomer material with various hardness or durometer gauges such that under pressure, insert 56 yields and its shape is altered thereby absorbing energy. The elastomer body of insert 56 may have a series of holes or areas with less material to provide more room for deforming the insert. Insert 56 may also include a large pocket of air or gas enclosed within its elastomer body or a series of smaller air pockets also enclosed within its elastomer body to provide some pneumatic resiliencies to insert 56. Many variations of designs of insert 56 are possible within the spirit and scope of the present invention.

Figure 5:
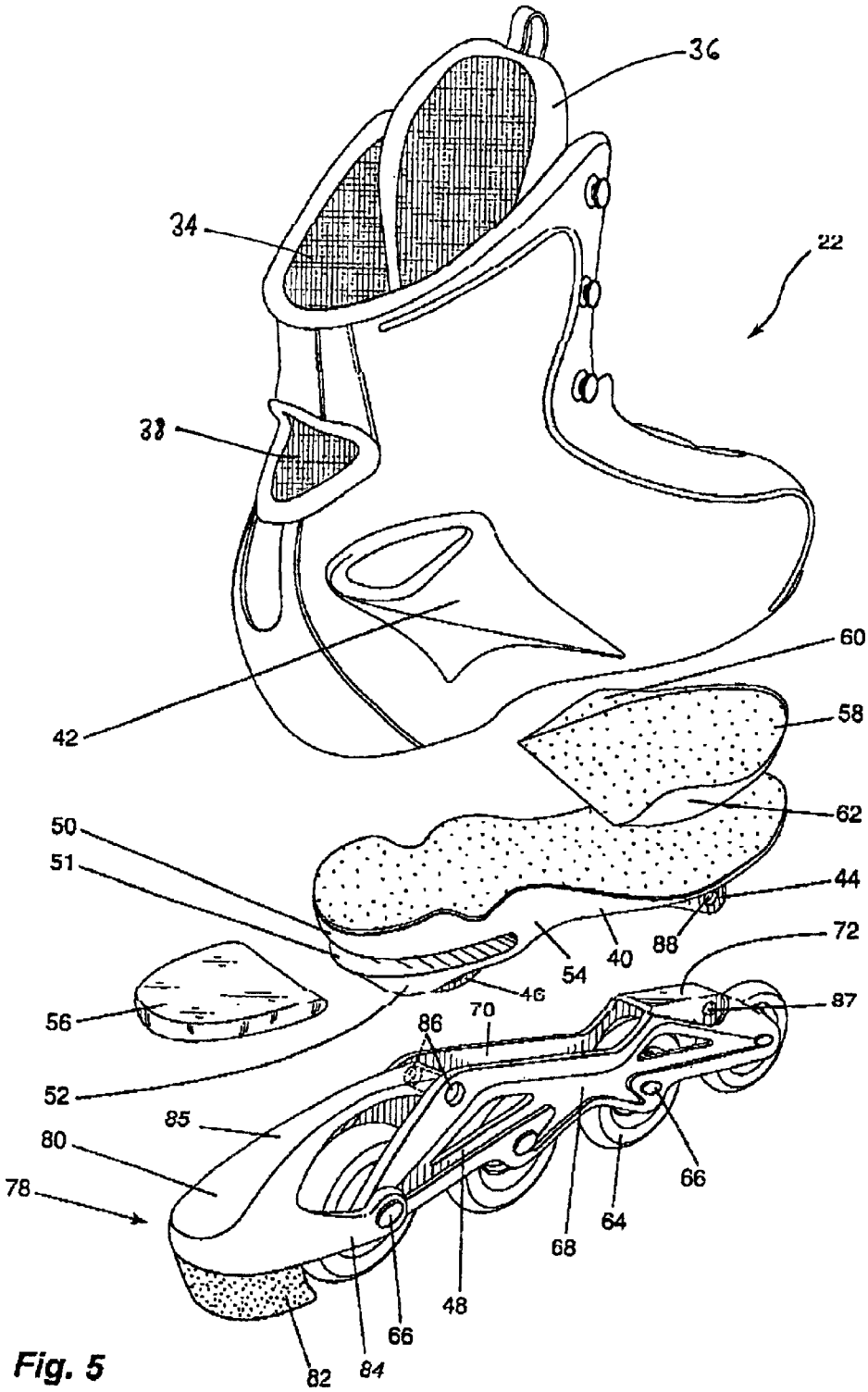
FIG. 5 is an exploded perspective view of the in-line roller skate shown in FIG. 1.
Figure 6:
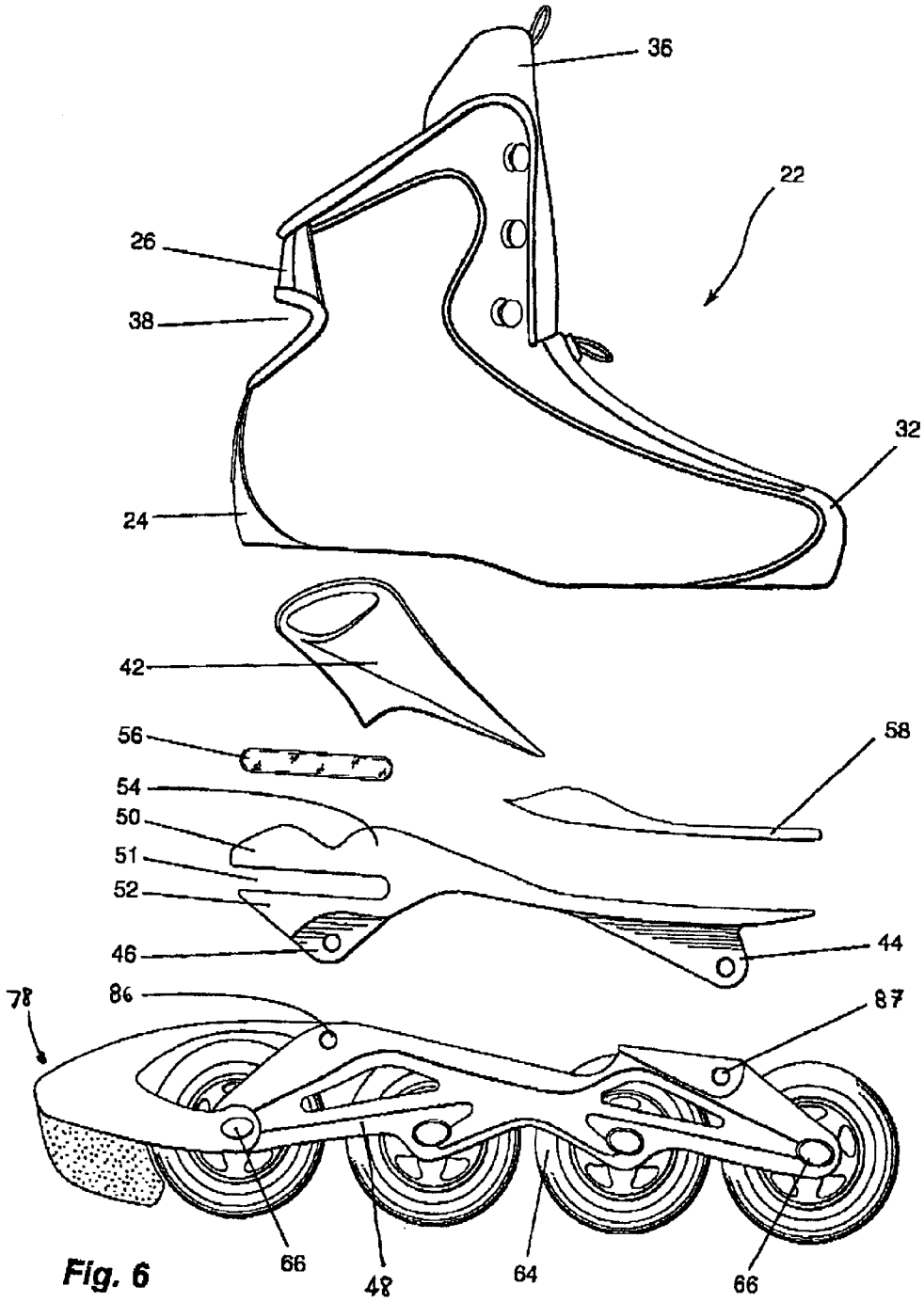
FIG. 6 is an exploded side elevational view of the in-line roller skate shown in FIG. 1.

As shown in FIG. 5, a midsole 58 is enclosed between the front portion of upper 22 and the front portion of outsole 40. Midsole 58 is made of a rigid plastic and includes two sidewalls 60 and 62 extending upwardly on each side of upper 22. Sidewalls 60 and 62 provide added lateral forefoot support to skate boot 20.

A series of wheels 64 are mounted to chassis 48 with a series of fasteners 66 acting as rotational axis for each wheel 64 as is well known in the art. Chassis 48 consists of two parallel rails 68 and 70 housing and rotatably supporting each wheel 64. The front portion of chassis 48 comprises a bridge portion 72 integrally connecting rails 68 and 70 whereas the rear end of chassis 48 is open. Chassis 48 is mounted to skate boot 20 at the front by inserting bridge portion 72 in between the front mounting brackets 44 and securing them together with a sufficiently long bolt inserted into aligned apertures 87 and 88 of chassis 48 and mounting brackets 44; the bolt being fastened with an appropriate nut. The rear portion of chassis 48 is mounted to skate boot 20 by inserting mounting bracket 46 in between rails 68 and 70 and again inserting into aligned apertures 86 of both rails 68, 70 and mounting bracket 46 a sufficiently long bolt 76 with appropriate nut in order to secure the rear portion of chassis 48 to the rear portion of skate boot 20.

A brake 78 is mounted to the rear of skate boot 20. Brake 78 comprises a rigid plastic frame 80 and a brake pad 82 made of rubber to provide the required friction for efficient braking. Frame 80 includes two attachment arms 84 extending laterally from brake pad 82 and secured to the nut and bolt assembly 66 of the rear wheel 64. A third attachment arm 85 extends above rear wheel 64 and is secured to the nut and bolt 76 of chassis 48 as best shown in FIG. 5.

In use, the wheels 64 of the skate encounter a variety of surfaces, some of them rough and bumpy which induce shocks and vibrations to wheels 64 and chassis 48. As wheels 64 roll upon uneven terrain, the various bumps and holes in the skating surface impact the wheels and the shocks are transferred through each axle bolts 66 to chassis 48. The repetition of shocks to wheels 64 induces vibrations to chassis 48 which in turn transfers both shocks and vibrations to skate boot 20. The vibrations are caused by repetitive shocks to a single wheel 64 and/or by the same shock hitting each of the four wheels 64 consecutively. The vibrations are then transferred to chassis 48. Shocks and vibrations are finally transferred to outsole 40 of skate boot 20 through the front and rear connecting bolts 74 and 76 and eventually to the skater's foot causing discomfort to the skater.

At the front end of outsole 40, shocks and vibrations are transferred to the skater's foot relatively unhindered through connecting bolt 74 linking mounting brackets 44 to chassis 48. However, at the heel portion of outsole 40, shocks and vibrations are transferred from chassis 48 through connecting bolt 76 to the mounting bracket 46 which is integral with the lower platform 52 of the fork-like heel structure of outsole 40. Shocks and vibrations are then partially transferred through deformable insert 56 sandwiched between upper and lower platforms 50 and 52 which has the effect of dissipating a significant portion of the shocks and vibrations about the skater's heel. The fork-like heel structure of outsole 40 is able to bend at its intersection portion 54 such that upper and lower platforms 50 and 52 squeeze and compress deformable insert 56 under the weight of the skater and the impulses of the shocks coming from chassis 48. As well vibrations coming from chassis 48 are partially absorbed by insert 56 before these are felt by the skater's heel.

Positioning insert 56 into outsole 40 as opposed to between the outsole and the chassis has the net advantage that the chassis 48 is mounted rigidly to outsole 40 and is therefore as responsive to the maneuvering of the skater as a standard mounted chassis but with the added benefit that shocks and vibrations are attenuated before reaching the skater's heel. No tilting movement occurs between chassis 48 and skate boot 20 and this provides the skater with a rigid assembly that is responsive. Intersection portion 54 may bend vertically to allow flexure of upper and lower platforms 50 and 52 toward each other, however intersection portion 54 is rigid laterally and greatly impedes torsional movement of lower platform 52 which would allow chassis 48 to get marginally out of alignment with skate boot 20 during turning or accelerating maneuvers and give the skater a feeling of instability.

Figure 7:
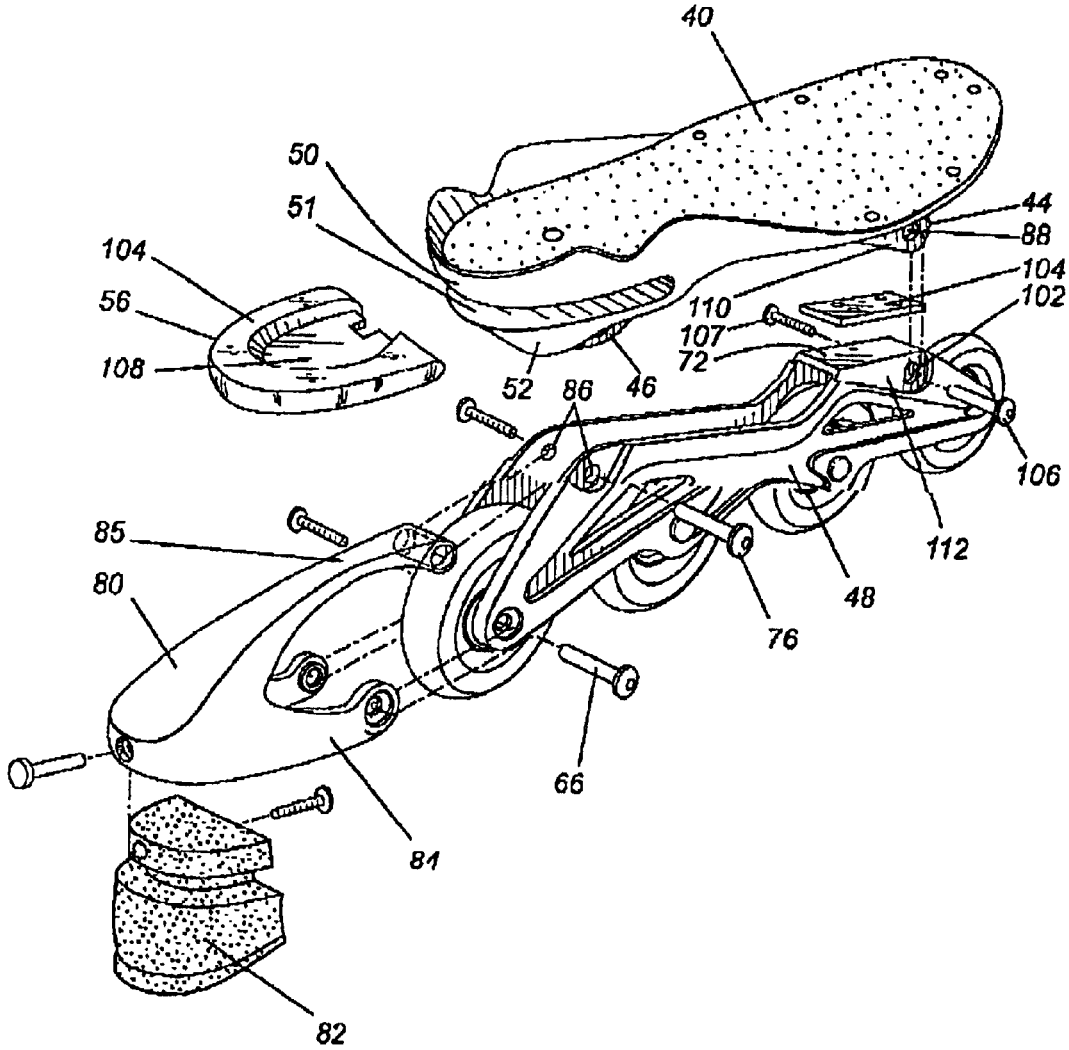
FIG. 7 is an exploded perspective view of the bottom section of an in-line roller skate according to a second embodiment of the invention.
Figure 8:
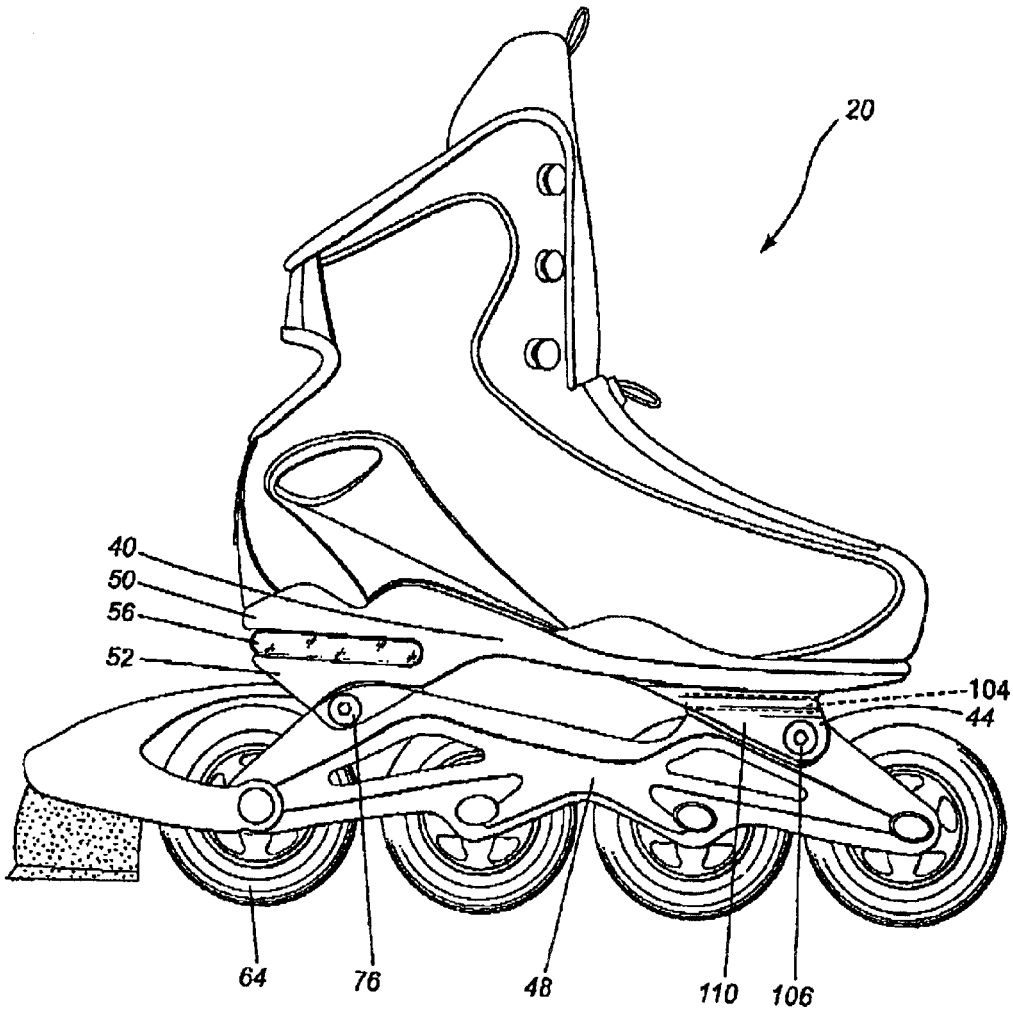
FIG. 8 is a right side elevational view of an in-line roller skate according to the second embodiment shown in FIG. 7.
Figure 9:
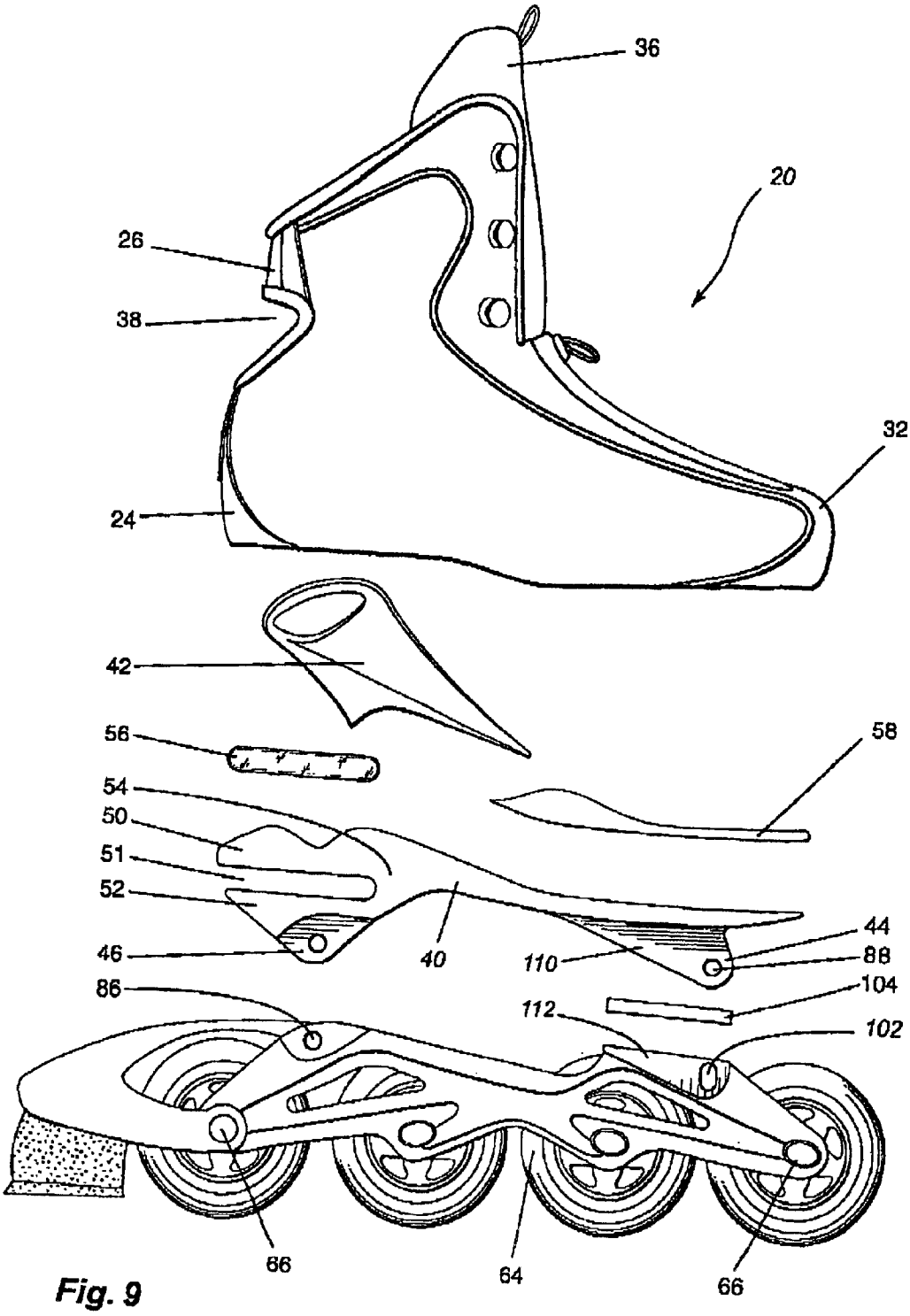
FIG. 9 is an exploded side elevational view of the in-line roller skate shown in FIG. 8.

FIGS. 7 to 9 illustrate a second embodiment of the mounting of skate boot 20 onto chassis 48. In this particular embodiment, the front end of chassis 48, is provided with vertical slots 102 on each side of chassis 48 instead of apertures 87 (FIG. 5) for securing chassis 48 to the mounting brackets 44 of outsole 40. A resilient member 104 such as a flat deformable rubber is installed between the bridge portion 72 of chassis 48 and the underside of oustsole 40. Chassis 48 is secured to front mounting brackets 44 by inserting axle bolt 106 through apertures 88 and through vertical slots 102 and threading screw 107 to the threaded inside portion of axle bolt 106. This arrangement allows the front end of chassis 48 to move up and down relative to skate boot 20 thereby absorbing at the front of the skate, shocks and vibrations induced by a rough skating surface. The shaft portion of axle bolt 106 travels inside slots 102 while front mounting brackets 44 slide along the sides of chassis 48. The vertical range of motion of chassis 48 relative to skate boot 20 being defined by the length of slots 102. In normal condition the shaft portion of axle bolt 106 rests on the upper portion of vertical slots 102. In use, when the front wheels of chassis 48 hit an obstacle on the skating surface, the impulse of the shock pushes the bridge portion 72 of chassis 48 upward toward outsole 40 thereby squeezing resilient member 104 which has the effect of attenuating the transfer of shock waves from the front end of chassis 48 to skate boot 20. Similarly, when the wheels of chassis 48 hit a series of bumps, which induce vibrations into chassis 48, the elastic rubbery nature of resilient member 104 absorbs at least partially some of these vibrations and prevents the transfer of these vibrations to the skater's forefoot.

As in the first embodiment depicted in FIGS. 1 to 6, the rear or heel portion of outsole 40 is split in two segments including an upper platform 50 and a lower platform 52 which forms a fork-like heel structure. The fork-like heel structure includes an absorption insert 56 made of deformable and elastic material which is sandwiched between upper and lower platforms 50 and 52. Absorption insert 56 acts as a cushioning and vibration absorption device that attenuates the transfer of shocks and vibrations to the skater's heel as previously described.

In FIG. 7 is shown an alternate embodiment of insert 56 in which its central portion 108 is thinner than its peripheral portion 109 giving insert 56 the general shape of horseshoe. In this configuration, the peripheral portion 109 provides the absorbing action as it expends laterally outwardly and inwardly into central portion 108 under the pressure of a shock or the vibrations of multiple shocks. Peripheral portion 109 may have air pockets to vary the behavior of insert 56.

As previously stated, insert 56 may take a variety of shapes to provide the desired dampening between upper and lower platforms 52 and 50 without departing from the spirit of the invention.

The combination of absorption insert 56 near the skater's heel and resilient member 104 installed between bridge portion 72 and outsole 40 in the forefoot area therefore at least partially isolate the skater's foot from chassis 48 and provide a more comfortable ride. The transfers of shocks and vibrations through the two attachment points of chassis 48 to skate boot 20, namely through front and rear mounting brackets 44 and 46, are impeded and attenuated. However, the longitudinal stability of chassis 48 relative to outsole 40 and therefore skate boot 20 is ensured by the rigid connection of rear mounting brackets 46 to chassis 48 which maintains chassis 48 and skate boot 20 aligned vertically and longitudinally.

The connection of the front portion of chassis 48 to mounting brackets 44 with axle bolt 106 inserted through vertical slots 102 and apertures 88 produces a less longitudinally stable mounting which is compensated by the inner surface of the walls 11 of mounting brackets 44 being maintained at close proximity of side walls 112 of chassis 48 by the pressure of axle bolt 106. The walls 110 extend downwardly onto side walls 112 and are sufficiently broad to provide a large contacting area between mounting brackets 44 and side walls 112 of chassis 48 to reduce to a minimum any deviation of the front end of chassis 48 from alignment with skate boot 20 . Furthermore, the rigid connection of the rear mounting brackets 46 to chassis 48 and the fact that both mounting bracket extend from the same outsole 40 provides added rigidity to the front end mounting of chassis 48. In order to misalign the front end of chassis 48, the walls 110 of mounting brackets 44 must themselves get distorted or bend or the entire outsole 40 has to distort and bend.

Resilient member 104 is a generally rectangular flat synthetic rubber part adapted for insertion between mounting brackets 44 and configured to rest on bridge portion 72. However resilient member 104 may take a variety of shape and size as well as using different materials having specific properties. For instance, resilient member 104 may have a bulging central portion that is flatten when installed; this bulging central portion may comprise a deformable air pocket providing added resiliency to resilient member 104.

Figure 10:
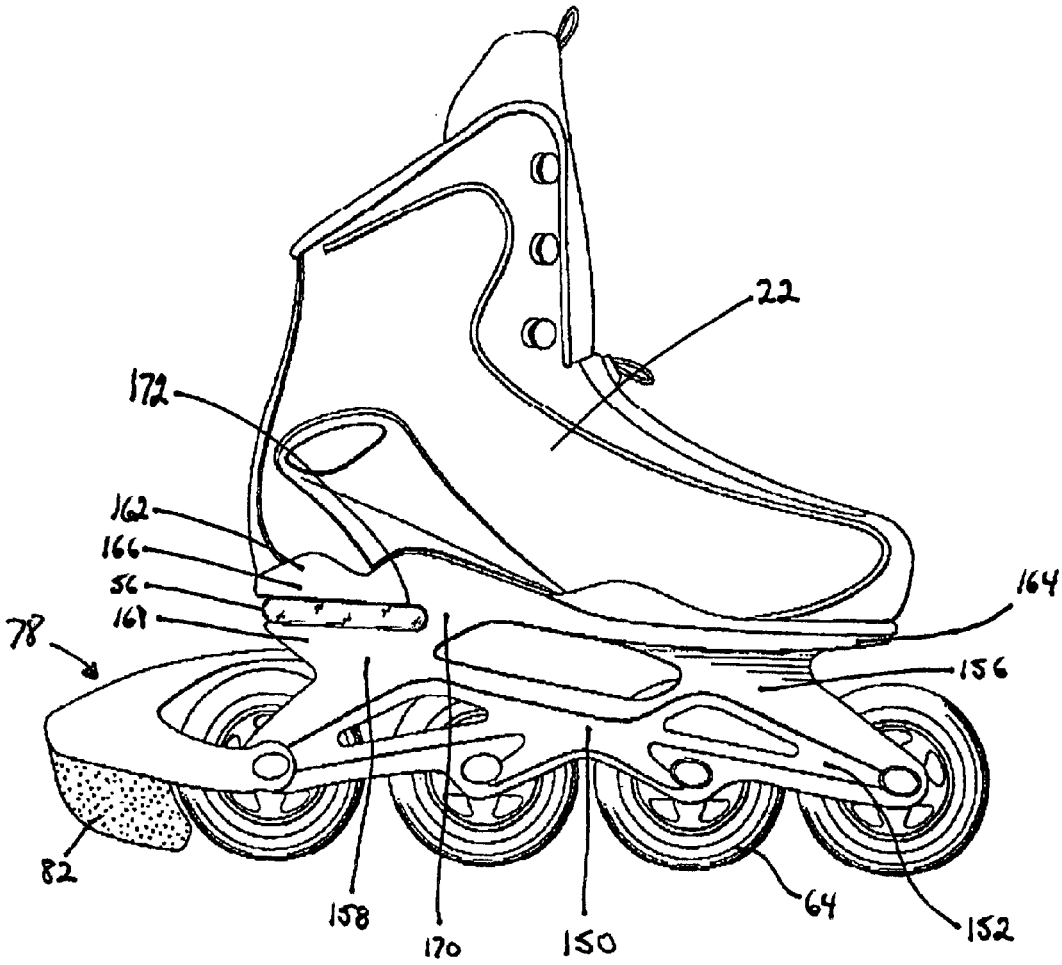
FIG. 10 is a right side elevational view of an in-line roller skate according to a third embodiment of the invention.

FIG. 10 illustrates a further variant of the invention in which the chassis and the outsole of the in-line skate are made into a single piece of a rigid plastic. As shown in FIG. 10, a chassis 150 is molded into a single unit and mounted to the bottom portion of upper 22. Chassis 150 comprises two parallel rails 152 and 154 (one shown) extending upwardly into a front pedestal 156 and a rear pedestal 158 integrally connected to an outsole 160. Outsole 160 extends the entire length of upper 22 from heel portion 162 to front portion 164. Molding together as a single unit, outsole 160 and the wheel carrying chassis to form chassis 150 eliminates the process of assembling these two parts thereby streamlining the assembly of the in-line skate and reduces overall costs.

The single unit chassis 150 is rigid at front portion 164 and provides a level of shock and vibration absorption at heel portion 162. As with the other embodiments previously described, heel portion 162 is split into two segments including an upper platform 166 and a lower platform 168 which form a fork-like heel structure. Upper and lower platforms 166 and 168 branch out from an intersection portion 170 separating into two segments heel portion 162 forming a cavity 172. Heel portion 162 is flexible at intersection portion 170. A deformable absorption insert 56 shaped to conform to cavity 172, is inserted into cavity 172 and sandwiched between upper and lower platforms 166 and 168. Advantageously, chassis 150 being a single unit, it is firmly connected to upper 22 and this makes for an in-line skate which is a very responsive during maneuvering. There is no possible movement or play between various parts yet heel portion 162 provides a level of shock and vibration absorption.

In use, shocks and vibrations from wheels 64 are transferred through rear pedestal 158 and are to a great extend, transferred through deformable insert 56 which has the effect of dissipating a significant portion of the shocks and vibrations about the skater's heel. The fork-like heel structure of heel portion 162 is able to bend at its intersection portion 170 such that upper and lower platforms 166 and 168 squeeze and compress deformable insert 56 under the weight of the skater and the impulses of the shocks coming from the skating surface dissipating a significant portion of the shocks at the skater's heel. In a similar fashion, vibrations are also partially dissipated by deformable insert 56 before these are felt by the skater's heel.

Figure 11:
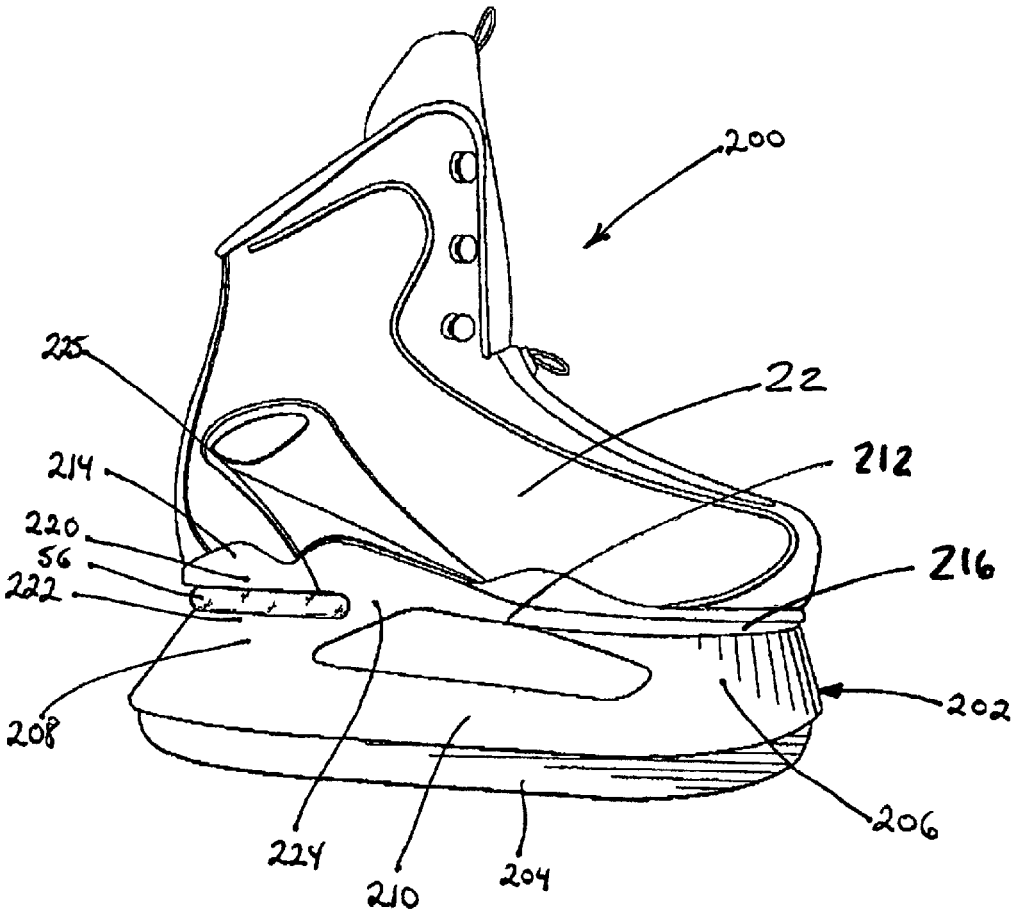
FIG. 11 is a right side elevational view of an ice skate according to a fourth embodiment of the invention.

FIG. 11 illustrates another variant of the invention. An ice skate 200 is disclosed. Ice skate 200 comprises an upper 22, a blade holder 202 and a blade 204. Blade holder 202 comprises a front pedestal 206, a rear pedestal 208 and a bridge portion 210 connecting front and rear pedestals 206 and 208 of blade holder 202. Front and rear pedestals 206 and 208 extend upwardly into an outsole 212 extending the entire length of upper 22 from heel portion 214 to front portion 216. The outsole 212 of blade holder 202 is preferably glued, nailed or riveted to upper 22.

Ice skates such as recreational ice skates are most often used outside on lakes, ponds, rivers and ice rinks that are not groomed and resurfaced. These skating surfaces may be bumpy and rough. To alleviate the shocks and vibrations caused by these rough surfaces, heel portion 214 of blade holder 202 is split into two segments including an upper platform 220 and a lower platform 222 which form a fork-like heel structure. Upper and lower platforms 220 and 222 branch out from an intersection portion 224 separating into two segments heel portion 214 and forming a cavity 225. Heel portion 214 is therefore flexible at intersection portion 224. A deformable absorption insert 56 shaped to conform to cavity 225 is inserted into cavity 225 and sandwiched between upper and lower platforms 220 and 222. Blade holder 202 is molded into a frame connecting front and rear pedestals 206 and 208 and bridge portion 210 to outsole 212. However, a separate holder comprising front and rear pedestals 206 and 208 and bridge portion 210 is also contemplated which would be riveted to a separate outsole comprising front and heel portion 216 and 214; the outsole being glued or otherwise connected to upper 22 and deformable absorption insert 56 being inserted into heel portion 214 of the separate outsole.

Either variants of the ice skate would perform in the same manner wherein in use, shocks and vibrations from the ice surface are transferred at the heel of ice skate 200 through rear pedestal 208 and are to a great extend, transferred through deformable insert 56 which has the effect of dissipating a significant portion of the shocks and vibrations about the skater's heel.

The above description of preferred embodiments should not be interpreted in a limiting manner since other variations, modifications and refinements are possible within the spirit and scope of the present invention. The scope of the invention is defined in the appended claims and their equivalents.

What is claimed is:

1. An inline roller skate comprising;

(a) a skate boot comprising an upper for enclosing and supporting a human foot, said upper comprising a bottom portion;

(b) a chassis carrying a plurality of aligned wheels, said chassis having front and rear portions;

(c) an outsole covering said bottom portion of said upper, said outsole comprising a heel portion having a fork structure comprising upper and lower platforms and a rear mounting bracket extending downwardly from said lower platform for mounting said outsole to said rear portion of said chassis; and (d) an insert sandwiched between said upper and lower platforms for reducing shocks and vibrations transferred from said chassis to the human foot when one of said aligned wheels abuts an obstacle.

2. An in-line roller skate as defined in claim 1 wherein said upper and lower platforms define a cavity and said insert is shaped to conform to said cavity.

3. An in-line roller skate as defined in claim 2 wherein said insert is made of a deformable elastomer material.

4. An in-line roller skate as defined in claim 3 wherein said upper platform and said lower platform branch out from an intersecting portion of said fork structure, said upper platform and said lower platform being adapted to flex at said intersecting portion for compressing said insert when one of said aligned wheels abuts an obstacle.

5. An in-line roller skate as defined in claim 4 wherein said insert comprises at least one air pocket.

6. An in-line roller skate as defined in claim 4 wherein said insert comprises a central portion and a peripheral portion, said central portion being thinner than said peripheral portion.

7. An in-line roller skate as defined in claim 4 wherein said insert comprises a bulging central portion.

8. An in-line roller skate as defined in claim 4 wherein said insert comprises a plurality of holes.

9. An in-line roller skate as defined in claim 4 wherein said boot comprises a midsole enclosed between said bottom portion of said upper and said front portion of said outsole.

10. An in-line roller skate as defined in claim 4 wherein said rear mounting bracket comprises an aperture extending perpendicularly relative to a longitudinal axis of said skate.

11. An in-line roller skate as defined in claim 10 wherein said chassis comprises two parallel rails with co-axial apertures at said rear portion of said chassis, said co-axial apertures being aligned with said aperture of said rear mounting bracket.

12. An in-line roller skate as defined in claim 11 wherein said skate comprises a rear fastener passing through said aperture of said rear mounting bracket and said co-axial apertures of said rails.

13. An in-line roller skate as defined in claim 12 wherein said rear fastener comprises a bolt and a nut.

14. An in-line roller skate as defined in claim 10 wherein said outsole comprises front mounting brackets extending downwardly from a front portion of said outsole for mounting said outsole to said front portion of said chassis.

15. An in-line roller skate as defined in claim 14 wherein said chassis comprises two parallel rails having co-axial apertures at said rear portion of said chassis, said co-axial apertures being aligned with said aperture of said rear mounting bracket, and a bridge portion connecting said rails at said front portion of said chassis, said bridge portion comprising an aperture aligned with said co-axial apertures of said front mounting brackets, said skate comprising a front fastener passing through said co-axial apertures of said front mounting brackets and said aperture of said bridge portion and a rear fastener passing through said aperture of said rear mounting bracket and said co-axial apertures of said rails.

16. An in-line roller skate as defined in claim 14 wherein said chassis comprises two parallel rails and said front portion of said chassis comprises a bridge portion connecting said rails, said bridge portion comprising an aperture aligned with said co-axial apertures of said front mounting brackets.

17. An in-line roller skate as defined in claim 16 wherein said skate comprises a front fastener passing through said co-axial apertures of said front mounting brackets and said aperture of said bridge portion.

18. An in-line roller skate as defined in claim 17 wherein said front fastener comprises a bolt and a nut.

19. An in-line roller skate as defined in claim 14 wherein said front mounting brackets comprises co-axial apertures.

20. An in-line roller skate comprising:

(a) a skate boot comprising an upper for enclosing and supporting a human foot, said upper comprising a bottom portion;

(b) a chassis carrying a plurality of aligned wheels, said chassis comprising two parallel rails having front and rear portion extending upwardly into respective front and rear pedestals that are integrally formed with an outsole covering said bottom portion of said upper, said outsole comprising a heel portion having a fork structure comprising upper and lower platforms; and (c) an insert sandwiched between said upper and lower platforms for reducing shocks and vibrations transferred from said chassis to the human foot when one of said aligned wheels abuts an obstacle.

21. An in-line roller skate as defined in claim 20 wherein said upper and lower platforms define a cavity and said insert is shaped to conform to said cavity.

22. An in-line roller skate as defined in claim 21 wherein said insert is made of a deformable elastomer material.

23. An in-line roller skate as defined in claim 22 wherein said upper platform and said lower platform branch out from an intersecting portion of said fork structure, said upper platform and said lower platform being adapted to flex at said intersecting portion for compressing said insert when one of said aligned wheels abuts an obstacle.

24. An in-line roller skate as defined in claim 23 wherein said insert comprises at least one air pocket.

25. An in-line roller skate as defined in claim 23 wherein said insert comprises a central portion and a peripheral portion, said central portion being thinner than said peripheral portion.

26. An in-line roller skate as defined in claim 23 wherein said insert comprises a bulging central portion.

27. An in-line roller skate as defined in claim 23 wherein said insert comprises a plurality of holes.

* * * * *